United States Patent [19]

Gloss

[11] 3,954,632

[45] May 4, 1976

[54] SOFTENING ADDITIVE AND DETERGENT COMPOSITION

[75] Inventor: Robert Andrew Gloss, Cincinnati, Ohio

[73] Assignee: The Procter & Gamble Company, Cincinnati, Ohio

[22] Filed: Feb. 16, 1973

[21] Appl. No.: 333,104

[52] U.S. Cl. ..... 252/8.8; 252/8.75; 252/155; 252/528; 252/547; 252/DIG. 14

[51] Int. Cl.[2] ..... D06M 13/46; D06M 11/12

[58] Field of Search ..... 252/8.8, 547, 155, DIG. 14

[56] References Cited

UNITED STATES PATENTS

| | | | |
|---|---|---|---|
| 3,095,373 | 6/1963 | Blomfield | 252/8.8 |
| 3,630,929 | 12/1971 | vanDijk | 252/363.5 X |
| 3,729,416 | 4/1973 | Bruning et al. | 252/8.8 |

*Primary Examiner*—Richard D. Lovering

*Attorney, Agent, or Firm*—R. C. Witte; J. D. Schaeffer; F. L. Collins

[57] ABSTRACT

Detergent-compatible fabric softening and anti-static compositions containing particular smectite clay materials, cationic anti-static agents and acidic compatibilizing agents are described. The compositions permit the simultaneous attainment of fabric softening, static-reduction and cleansing effects of fabrics washed therein.

3 Claims, No Drawings

SOFTENING ADDITIVE AND DETERGENT COMPOSITION

BACKGROUND OF THE INVENTION

This invention relates to compositions adapted to the provision of fabric softening and anti-static effects in fabric laundering operations. More particularly, it relates to the provision of these effects while simultaneously cleansing fabrics in the presence of conventional synthetic detergent compounds and organic or inorganic detergent builders.

Various clay materials have been utilized in many different types of detergent systems for widely diverse purposes. Clays, for example, have been disclosed for utilization as builders (Schwartz and Perry, *Surface Active Agents*, Interscience Publishers, Inc., 1949, pp. 232 and 299); as water-softeners (British Pat. No. 461,221); as anti-caking agents (U.S. Pat. Nos. 2,625,513 and 2,770,600); as suspending agents (U.S. Pat. Nos. 2,594,257, 2,594,258 and 2,920,045); and as fillers (U.S. Pat. No. 2,708,185).

It is also well known that some clay materials can be deposited on fabrics to impart softening properties thereto. Such clay deposition is usually realized by contacting fabrics to be so treated with aqueous clay suspensions (see, for example U.S. Pat. Nos. 3,033,699 and 3,594,221). The copending applications of Storm and Mirschl, Ser. No. 271,943, filed July 14, 1972, now abandoned; Ohren, Ser. No. 279,127, filed Aug. 9, 1972 now U.S. Pat. No. 3,852,211, Nirschl and Gloss, Ser. No. 305,416, filed Nov. 10, 1972, now U.S. Pat. No. 3,862,058; and Gloss and Nirschl, Ser. No. 305,417, filed Nov. 10, 1972; relate to the use of clays as softeners in laundry compositions.

While clays can provide softening properties, and in the presence of detergent and builder substances used in the cleansing or laundering of fabrics, they do not provide anti-static properties. Commercially acceptable fabric softeners additionally provide anti-static benefits, and such benefits have come to be expected by the user of such products. Indeed, fabrics coated with clays, while exhibiting a soft hand, tend to develop higher levels of static charge than the uncoated fabrics.

Various quaternary ammonium compounds known in the art possess anti-static properties. These compounds, while suitable in combination with clay materials to provide the anti-static properties which are not provided by the clays can be inhibited in their provision of anti-static effects by the presence of anionic substances conventionally employed in the cleansing of fabrics in laundering operations.

It is an object of the present invention to provide fabric softening and anti-static compositions capable of providing their effects in the presence of conventional detergent compositions to thereby concurrently launder, soften and impart anti-static benefits to fabrics.

It is another object of the present invention to provide compositions containing certain clay fabric softening agents and quaternary ammonium anti-static agents adapted to use in the washing cycle of a laundering operation.

These and the objects are obtained herein, as will be seen from the following disclosure.

SUMMARY OF THE INVENTION

The present invention is based in part upon the discovery that certain acidic materials, defined hereinafter, will mitigate the interactive effects of quaternary ammonium anti-static agents and conventional detergent laundering compositions. These materials, termed compatibilizing agents hereinafter, can be employed in combination with quaternary ammonium anti-static agents and clay fabric-softening materials in fabric-laundering operations to provide treated textile materials with simultaneous cleansing, anti-static and fabric-softening effects.

In its composition aspect, the present invention encompasses fabric-softening compositions containing as essential ingredients a particular smectite clay fabric-softening material, a quaternary ammonium fabric softening agent and an acidic compatibilizing agent. Such compositions can be conveniently employed by the housewife or other user by addition to the laundry washing bath provided by addition to water of a conventional laundry detergent composition. The present invention also encompasses as integral formulations compositions containing the materials hereinbefore-defined in combination with synthetic detergent compounds and organic or inorganic builder salts. Such compositions, merely added to water, provide in a single step the provision of a laundering bath adapted to the provision of simultaneous cleansing, softening and anti-static effects.

In a method aspect, the invention encompasses a method for simultaneously cleansing, softening and providing anti-static effects on fabrics or textiles which comprises treating the fabrics or textiles in an aqueous laundry bath containing detergent, clay, quaternary ammonium and compatibilizing agent as defined herein.

DETAILED DESCRIPTION OF THE INVENTION

Compositions suited herein as additives to the detergent washing bath of a laundering operation, and termed "additive compositions" herein comprise:

a. from about 5 to about 90% by weight of a smectite clay having an ion-exchange capacity of at least 50 meq/100 grams;

b. from about 1 to about 40% by weight of a substantially water-insoluble quaternary ammonium anti-static agent of the formula:

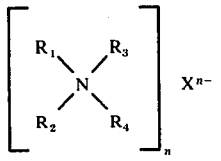

wherein $R_1$ and $R_2$ represent hydrocarbyl groups containing from about 10 to about 22 carbon atoms, $R_3$ and $R_4$ represent hydrocarbyl groups containing from 1 to about 4 carbon atoms, X is an anion and *n* is an integer from 1 to 3; and c. from about 1 to about 40% by weight of an acid compatibilizing agent selected from the group consisting of:

i. fatty acids having from about 8 to about 30 carbon atoms in the alkyl chain;

ii. compounds selected from the group consisting of benzene mono-, di- and tricarboxylic acid containing from 0 to 2 hydroxyl functions; and iii. mixtures of the above-described compounds.

Built laundry detergent compositions of the invention comprise (a) from about 2 to about 30% by weight of a synthetic detergent compound selected from the group consisting of anionic soap and non-soap detergents, nonionic synthetic detergents, ampholytic synthetic detergents, zwitterionic synthetic detergents and mixtures thereof; (b) from about 0 to about 60% by weight of an organic or inorganic detergent builder salt; (c) from about 1 to about 50% by weight of a smectite clay softening agent having an ion exchange capacity of at least about 50/meq/100 g; and (d) from about 0.5 to about 15% by weight of a substantially water-insoluble quaternary ammonium anti-static agent of the formula, $R_2N^+R'_2X^-$, wherein each R is an alkyl group containing from about 10 to about 22 carbon atoms and each R′ is an alkyl group containing from about 1 to about 4 carbon atoms and wherein X is an anion, e.g., $F^-$, $Cl^-$, $Br^-$, $OH^-$; and (e) from about 0.5 to about 15% of an acidic compound selected from the group consisting of (i) fatty acids having from about 8 to about 30 carbon atoms in the alkyl chain; (ii) compounds selected from the group consisting of benzene mono-, di- and tricarboxylic acid containing from 0 to 2 hydroxyl functions; and (iii) mixtures of the above-described compounds. The weight ratio of smectite-type clay to quaternary ammonium compound in the detergent compositions herein is from about 40:1 to about 1:1, and is preferably about 10:1 to 3:1. The quaternary ammonium compound and acidic compatibilizing agent are present in releasable combination in the compositions herein and in a weight ratio of quaternary ammonium compound to acidic compound of from about 1:5 to about 5:1. A preferred ratio is from 3:1 to 1:2.

The detergent compositions herein provide a solution pH of from about 7 to about 12 when dissolved in water at a concentration of about 0.12% by weight.

The compositions and method of this invention employ three essential ingredients; the clay softener; the quaternary ammonium anti-static agent; and the acidic compatibilizing agent. The detergent compositions of the invention additionally will comprise a water-soluble detergency compound and a detergency builder salt. The smectite clay functions to soften the laundered fabrics while the quaternary ammonium compound provides anti-static effects on the fabrics and adds an increment of softening benefits to the fabrics. The detergent and builder components provide the known cleansing and building effects. The various components of the compositions herein are described in greater detail hereinafter.

CLAY COMPOUNDS

The essential clay component of the present compositions consists of particular smectite clay materials. These smectite clays are present in the additive compositions of this invention at levels from about 5 to about 90%, preferably from 8 to 75% by weight. In the built detergent composition embodiments of this invention, the smectite clay is used in an amount from about 1 to about 50%, preferably from about 5 to about 25% by weight. The clays used herein are "impalpable," i.e., have a particle size which cannot be perceived tactilely. Impalpable clays have particle sizes below about 50 microns; the clays used herein have a particle size range of from about 5 microns to about 50 microns.

The clay minerals can be described as expandable, three-layer clays, i.e., alumino-silicates and magnesium silicates, having an ion exchange capacity of at least 50 meq/100 g. of clay. The term "expandable" as used to describe clays relates to the ability of the layered clay structure to be swollen, or expanded, on contact with water. The three-layer expandable clays used herein are those materials classified geologically as smectites.

Threr are two distinct classes of smectite-type clays; in the first, aluminum oxide is present in the silicate crystal lattice; in the second class of smectites, magnesium oxide is present in the silicate crystal lattice. The general formulas of these smectites are $Al_2(Si_2O_5)_2(OH)_2$ and $Mg_3(Si_2O_5)(OH)_2$, for the aluminum and magnesium oxide type clay, respectively. It is to be recognized that the range of the water of hydration in the above formulas can vary with the processing to which the clay has been subjected. This is immaterial to the use of the smectite clays in the present invention in that the expandable characteristics of the hydrated clays are dictated by the silicate lattice structure. Furthermore, atom substitution by iron and magnesium can occur within the crystal lattice of the smectites, while metal cations such as Na+, Ca++, as well as H+, can be co-present in the water of hydration to provide electrical neutrality. Except as noted hereinafter, such cation substitutions are immaterial to the use of the clays herein since the desirable physical properties of the clays are not substantially altered thereby.

The three-layer, expandable alumino-silicates useful herein are further characterized by a dioctahedral crystal lattice, while the expandable three-layer magnesium silicates have a trioctahedral crystal lattice.

As noted hereinabove, the clays employed in the compositions of the instant invention contain cationic counterions such as protons, sodium ions, potassium ions, calcium ions, magnesium ions, and the like. It is customary to distinguish between clays on the basis of one cation predominantly or exclusively absorbed. For example, a sodium clay is one in which the absorbed cation is predominantly sodium. Such absorbed cations can become involved in exchange reactions with cations present in aqueous solutions. A typical exchange reaction involving a smectite clay is expressed by the following equation:

$$\text{smectite clay (Na)} + NH_4OH \rightleftarrows \text{smectite clay } (NH_4) + NaOH$$

Since in the foregoing equilibrium reaction, one equivalent weight of ammonium ion replaces an equivalent weight of sodium, it is customary to measure cation exchange capacity (sometimes termed "base exchange capacity") in terms of milli-equivalents per 100 g. of clay (Meq./100 g.). The cation exchange capacity of clays can be measured in several ways, including by electrodialysis, by exchange with ammonium ion followed by titration or by a methylene blue procedure, all as fully set forth in Grimshaw, "The Chemistry and Physics of Clays," pp. 264–265, Interscience (1971). The cation exchange capacity of a clay mineral relates to such factors as the expandable properties of the clay, the charge of the clay, which, in turn, is determined at least in part by the lattice structure, and the like. The ion exchange capacity of clays varies widely in the range from about 2 meq/100 g. of kaolinites to about 150 meq/100 g., and greater, for certain clays of the montmorillonite variety. Illite clays have an ion exchange capacity somewherein the lower portion of the range, i.e., around 26 meq/100 g. for an average illite clay.

It has been determined that illite and kaolinite clays, with their relatively low ion exchange capacities, are not useful in the instant compositions. However, smectites, such as nontronite, having an ion exchange capacity of approximately 50 meq/100 g., saponite, which has an ion exchange capacity of around 70 meq/100 g., and montmorillonite, which has an ion exchange capacity greater than 70 meq/100 g., have been found to be useful in the instant compositions in that they are deposited on the fabrics to provide the desired softening benefits. Accordingly, clay minerals useful herein can be characterized as expandable, three-layer smectite clays having an ion exchange capacity of at least about 50 meq/100 g. A smectite clay known as "fooler clay," found in a relatively thin vein above the Black Hills, also has the requisite ion exchange properties characteristic of the clays useful herein and such "fooler clay" is also encompassed by the term "smectite clay," as used herein.

The smectite clays used in the compositions herein are all commercially available. Such clays include, for example, montmorillonite, volchonskoite, nontronite, hectorite, saponite, sauconite, and vermiculite. The clays herein are available under various tradenames, for example, Thixogel No. 1 (also, "Thixo-Jell") and Gelwhite GP from Georgia Kaolin Co., Elizabeth, N. J.; Volclay BC and Volclay No. 325, from American Colloid Co., Skokie, Ill.; Black Hills Bentonite BH450, from International Minerals and Chemicals; and Veegum Pro and Veegum F, from R. T. Vanderbilt. It is to be recognized that such smectite minerals obtained under the foregoing tradenames can comprise mixtures of the various discreet mineral entities. Such mixtures of the smectite minerals are suitable for use herein.

While any of the smectite clays having a cation exchange capacity of at least about 50 meq/100 g. are useful herein, certain clays are preferred. For example, Gelwhite GP is an extremely white form of smectite clay and is therefore preferred when formulating white granular detergent compositions. Volclay BC, which is a smectite clay mineral containing at least 3% of iron (expressed as $Fe_2O_3$) in the crystal lattice, and which has a very high ion exchange capacity, is one of the most efficient and effective clays for use in the instant compositions and is preferred from the standpoint of product performance. On the other hand, certain smectite clays marketed under the name "bentonite" are sufficiently contaminated by other silicate minerals that their ion exchange capacity falls below the requisite range, and such clays are of no use in the instant compositions.

Appropriate clay minerals for use herein can be selected by virtue of the fact that smectites exhibit a true 14A X-ray diffraction pattern. This characteristic pattern, taken in combination with exchange capacity measurements performed in the manner noted above, provides a basis for selecting particular smectite minerals for use in the compositions disclosed herein.

ANTI-STATIC AGENT

The quaternary ammonium anti-static agents will normally be employed in the additive compositions in an amount of from about 1 to about 40% and preferably from about 2 to about 25% by weight. The quaternary ammonium anti-static agent will normally be present in the detergent compositions of the invention in an amount of from about 0.5 to about 15% and preferably in an amount of from about 1 to about 10% by weight. Whether an additive or detergent composition of the invention is employed in providing an aqueous laundering bath or liquor, an amount sufficient to provide a concentration of quaternary ammonium compound in the bath or liquor of from about 2.5 to 1500 ppm will normally be employed. In general, the quaternary anti-stats are used in either type of composition at a clay-to-quaternary weight ratio of from about 40:1 to about 1:1, preferably from about 10:1 to about 3:1.

The anti-static agents useful herein are quaternary ammonium salts of the formula $$[R_2N^+R'_2]_nX^{n-}$$

wherein each R group is a hydrocarbyl (i.e., alkyl or alkenyl) group containing from about 10 to about 22 carbon atoms and each R′ group is a short-chain hydrocarbyl group containing from 1 to about 4 carbon atoms. X in the above compounds can be any salt-forming anion, e.g., halide, hydroxide, sulfate, carbonate, phosphate, etc. The charge on the anion is designated as $n-$, where $n$ is 1–3. The number of cationic ammonium groups, $n$, will equal the charge $n$, on the anion to provide electrical neutrality. Quaternary ammonium compounds wherein $n=1$ are commercially available and are preferred herein for this reason.

The quaternary ammonium anti-static agents herein are characterized by their limited solubility in water. That is to say, such quaternary salts are essentially insoluble in water, existing therein in what appears to be the mesomorphic liquid crystalline state. The insolubility of the quaternary salts used herein is a critical aspect of this invention inasmuch as water-soluble quaternary salts become chemically affixed to the surface of the clay. When the quaternary anti-static agent is affixed to the surface of the clay, it does not provide the desired anti-static effects on fabrics.

The quaternary ammonium anti-static agents used in this invention can be prepared in various ways well known in the art. Many such materials are commercially available. The quaternaries are often made from alkyl halide mixtures corresponding to the mixed alkyl chain lengths in fatty acids. For example, the "di-tallow" quaternaries are made from alkyl halides having mixed $C_{14}$–$C_{18}$ chain lengths. Such mixed di-long chain quaternaries are useful herein and are preferred from a cost standpoint.

As noted above, essentially any anionic group can be the counter-ion in the quaternary compounds used herein. The anionic groups in the quaternary compounds can be exchanged, one for another, using standard anion exchange resins. Thus, quaternary ammonium salts having any desired anion are readily available. While the nature of such anions has no effect on the compositions and processes of this invention, chloride ion is the preferred counter-ion from a cost standpoint.

The following are representative examples of substantially water-insoluble quaternary ammonium anti-static agents suitable for use in the compositions and processes of the instant invention. All of the quaternary ammonium compounds listed can be formulated in releasable combination with the detergent compositions herein, but the compilation of suitable quaternary compounds hereinafter is only by way of example and is not intended to be limiting of such compounds. Ditallowdimethylammonium chloride is an especially preferred quaternary anti-static agent for use herein by virtue of its low cost, low solubility and high anti-static activity; other useful di-long chain quaternary compounds are dicetyldimethylammonium chloride; bis-docosyldimethylammonium chloride; dodecyldimethylammonium chloride; ditallowdimethylammonium bromide; dioleoyldimethylammonium hydroxide; ditallowdiethylammonium chloride; ditallowdipropylammonium bromide; ditallowdibutylammonium fluoride, cetyldecylmethylethylammonium chloride; bis-[ditallowdimethylammonium]sulfate; tris-[ditallowdimethylammonium]-phosphate; and the like.

COMPATIBILIZING AGENT

The essential acidic compatibilizing agent is used in an amount of from about 1 to about 40%, preferably from about 2 to about 20% by weight of the ternary mixture of essential components, i.e., the additive compositions of the invention. In the built detergent embodiments, said compatibilizing agent is used in an amount from about 0.5 to about 15%, preferably from about 1 to about 10% by weight. Normally, in either the additive or detergent embodiments of the invention an amount of acidic compatibilizing agent sufficient to provide a weight ratio of quaternary ammonium compound to acidic component of from about 5:1 to about 1:5, and preferably from 3:1 to 1:2, is employed.

The compatibilizing agent can be represented by fatty acids having from about 8 to about 30 carbon atoms in the alkyl chain. Said acids can be saturated and unsaturated; they can be of straight or branched chain configuration. Examples of this class of fatty acids include: caprylic acid pelargonic acid, capric acid, undecanoic acid, lauric acid, tridecanoic acid, myristic acid, palmitic acid, stearic acid, oleic acid, linoleic acid, arachidic acid, behenic acid, lignoceric acid, and cerotic acid.

Preferred are fatty acids having from about 12 to about 20 carbon atoms. Examples of these preferred species include lauric acid, myristic acid, palmitic acid, oleic acid, stearic acid and arachidic acid. These acids can be of synthetic or natural origin. Examples of the like synthesis and recovering processes are well known in the art.

Other useful acidic components are the benzene mono-, di- and tricarboxylic acids having from 0 to 2 hydroxyl functions. Examples of such acids are benzoic acid, salicylic acid, phthalic acid and benzene tri-carboxylic acid. Particularly preferred is salicylic acid.

DETERGENT

From about 2 to about 30% by weight, preferably from about 5 to about 20% by weight, of the detergent compositions comprise an organic detergent selected from the group consisting of anionic, nonionic, ampholytic and zwitterionic detergents and mixtures thereof. Examples of organic detergents of these types are described in U.S. Pat. No. 3,579,454; incorporated herein by reference, column 11, line 45 to column 19, line 64.

Preferred for use herein are the alkali metal alkyl benzene sulfonates, in which the alkyl group contains from about 9 to about 20 carbon atoms in straight chain or branched-chain configuration, e.g., those of the type described in U.S. Pat. Nos. 2,220,099 and 2,477,383 (especially valuable are linear straight chain alkyl benzene sulfonates in which the average of the alkyl groups is about 11.8 carbon atoms and commonly abbreviated as $C_{11.8}$LAS).

Other preferred detergents for use herein include alkyl ether sulfates. These materials have the formula $RO(C_2H_4O)_xSO_3M$ wherein R is alkyl or alkenyl of about 10 to about 20 carbon atoms, $x$ is 1 to 30, and M is a water-soluble cation such as alkali metal, ammonium and substituted ammonium. The alkyl ether sulfates useful in the present invention are condensation products of ethylene oxide and monohydric alcohols having about 10 to about 20 carbon atoms. Preferably, R has 14 to 18 carbon atoms. The alcohols can be derived from fats, e.g., coconut oil or tallow, or can be synthetic. Lauryl alcohol and straight chain alcohols derived from tallow are preferred herein. Such alcohols are reacted with 1 to 30, and especially 1 to 6, molar proportions of ethylene oxide and the resulting mixture of molecular species, having, for example, an average of 3 moles of ethylene oxide per mole of alcohol, is sulfated and neutralized.

Specific examples of alkyl ether sulfates of the present invention are sodium coconut alkyl ethylene glycol ether sulfate; sodium tallow alkyl triethylene glycol ether sulfate; and sodium tallow alkyl hexaoxyethylene sulfate.

Other preferred detergents utilizable herein are olefin sulfonates having about 12 to about 24 carbon atoms. The term "olefin sulfonates" is used herein to mean compounds which can be produced by the sulfonation of $\alpha$-olefins by means of uncomplexed sulfur trioxide, followed by neutralization of the acid reaction mixture in conditions such that any sultones which have been formed in the reaction are hydrolyzed to give the corresponding hydroxy-alkanesulfonates. The sulfur trioxide can be liquid or gaseous, and is usually, but not necessarily, diluted by inert diluents, for example by liquid $SO_2$, chlorinated hydrocarbons, etc., when used in the liquid form, or by air, nitrogen, gaseous $SO_2$, etc., when used in the gaseous form.

The $\alpha$-olefins from which the olefin sulfonates are derived are mono-olefins having 12 to 24 carbon atoms, preferably 14 to 16 carbon atoms. Preferably, they are straight chain olefins. Examples of suitable 1-olefins include 1-dodecene, 1-tetradecene; 1-hexadecene; 1-octadecene; 1-eicosene and 1-tetracosene.

In addition to the true alkene sulfonates and a portion of hydroxy-alkanesulfonates, the olefin sulfonates can contain minor amounts of other materials, such as alkene disulfonates depending upon the reaction conditions, proportion of reactants, the nature of the starting olefins and impurities in the olefin stock and side reactions during the sulfonation process.

A specific anionic detergent which has also been found excellent for use in the present invention is described more fully in the U.S. Pat. No. 3,332,880 of Phillip F. Pflaumer and Adrian Kessler, issued July 25, 1967, titled "Detergent Composition," the disclosure of which is incorporated herein by reference.

BUILDER SALTS

The detergent compositions of the instant invention contain, as an essential component, an alkaline, polyvalent anionic detergent builder salt. In the present compositions these water-soluble alkaline builder salts serve to maintain the pH of the laundry solution in the range of from about 7 to about 12, preferably from about 8 to about 11. Furthermore, these builder salts enhance the fabric cleaning performance of the overall compositions while at the same time serve to suspend particulate soil released from the surface of the fabrics and prevent its redeposition on the fabric surfaces. Surprisingly, although the detergency builder salts serve to suspend clay soils of the kaolinite and illite types and prevent their redeposition on fabrics, they do not appear to interfere with the deposition on fabric surfaces of the smectite-type clay softeners used herein. Furthermore, these poly-anionic builder salts have been found to cause the smectite-type clays present in the granular detergent formulations of the invention to be readily and homogeneously dispersed throughout the aqueous laundering medium with a minimum of agitation. The homogeneity of the clay dispersion is necessary for the clay to function effectively as a fabric softener, while the ready dispersability allows granular detergent compositions to be formulated.

Suitable detergent builder salts useful herein can be of the poly-valent inorganic and poly-valent organic types, or mixtures thereof. Non-limiting examples of suitable water-soluble, inorganic alkaline detergent builder salts include the alkali metal carbonates, borates, phosphates, polyphosphates, tripolyphosphates, bicarbonates, silicates and sulfates. Specific examples of such salts include the sodium and potassium tetraborates, perborates, bicarbonates, carbonates, tripolyphosphates, orthophosphates and hexametaphosphates.

Examples of suitable organic alkaline detergency builder salts are: (1) water-soluble amino polyacetates, e.g., sodium and potassium ethylenediamine tetraacetates, nitrilotriacetates and N-(2-hydroxyethyl)nitrilodiacetates; (2) water-soluble salts of phytic acid, e.g., sodium and potassium phytates; (3) water-soluble polyphosphonates, including, sodium, potassium and lithium salts of ethane-1-hydroxy-1,1-diphosphonic acid; sodium, potassium and lithium salts of methylenediphosphonic acid and the like.

Additional organic builder salts useful herein include the polycarboxylate materials described in U.S. Pat. No. 2,264,103, including the water-soluble alkali metal salts of mellitic acid. The water-soluble salts of polycarboxylate polymers and copolymers such as are described in U.S. Pat. No. 3,308,067, incorporated herein by reference, are also suitable herein. It is to be understood that while the alkali metal salts of the foregoing inorganic and organic poly-valent anionic builder salts are preferred for use herein from an economic standpoint, the ammonium, alkanolammonium, e.g., triethanolammonium, diethanolammonium, and the like, water-soluble salts of any of the foregoing builder anions are useful herein.

Mixtures of organic and/or inorganic builders can be used herein. One such mixture of builders is disclosed in Canadian Pat. No. 755,038, e.g., a ternary mixture of sodium tripolyphosphate, trisodium nitrilotriacetate and trisodium ethane-1-hydroxy-1,1-diphosphonate.

While any of the foregoing alkaline poly-valent builder materials are useful herein, sodium tripolyphosphate, sodium nitrilotriacetate, sodium mellitate, sodium citrate and sodium carbonate are preferred herein for this builder use. Sodium tripolyphosphate is especially preferred herein as a builder both by virtue of its detergency builder activity and its ability to homogeneously and quickly disperse the smectite clays throughout the aqueous laundry media without interfering with clay deposition on the fabric surface. Sodium tripolyphosphate is also especially effective for suspending illite and kaolinite clay soils and retarding their redeposition on the fabric surface.

The detergent builders are used at concentrations of from about 0 to about 60%, preferably 20 to 50%, by weight of the detergent compositions of this invention.

The clay-containing compositions of this invention are in granular form. The compositions can be conveniently prepared in standard fashion by admixing the clay and detergent, builder and optional ingredients, if any, in a crutcher and spray-drying the mixture to form granules. Following this, the quaternary ammonium anti-static agent and acidic compatibilizing agent can be sprayed on the granules from a melt. It is a critical aspect of this invention to avoid affixing the quaternary compound to the surface of the clay by an ion exchange mechanism; accordingly, it is preferable to avoid spraying the detergent granules with an aqueous solution or suspension of the quaternary compound. The ion-exchange problem is avoided by employing a melt of the quaternary compound and at least a portion of the acidic compatibilizing agent to spray the granules. The compositions are then added to water, or to a detergent bath as the case may be, to provide a laundering liquor. Soiled fabrics are added to the laundering liquor and cleansed in the usual manner. The effective amount of the additive or detergent compositions to be used will depend to an extent on the weight of clothes being laundered and their degree of soiling. Aqueous laundering baths prepared thereby provide adequate cleaning, softening and anti-static benefits with soiled fabrics, especially cotton and cotton/polyester blends.

It will be appreciated that the method of simultaneously cleansing, softening and reducing static build-up on laundered textiles can be conveniently practiced by providing an aqueous treating liquor in a number of ways. A suitable washing liquor can be prepared by adding, for example, a commercially available built anionic-based laundry detergent composition into a washing machine at a concentration of about 0.12% and separately, adding an additive composition of the invention as defined hereinbefore. Suitable treating liquors will normally contain:

| | |
|---|---|
| Smectite clay | 5 to 5000 ppm |
| Quaternary ammonium compound | 2.5 to 1500 |
| Acidic compatibilizing agent | 2.5 to 1500 (1:5 to 5:1) |
| Detergent | 10 to 3000 |
| Builder | 0 to 6000 |

The additive and built detergent compositions and processes of the instant invention are illustrated by the following examples.

EXAMPLE I

| Component | | Weight Percent |
|---|---|---|
| Anionic surfactant* | | 16.6 |
| Sodium tripolyphosphate | | 43.3 |
| Sodium silicate | | 5.8 |
| Sodium sulfate | | 10.0 |
| Gelwhite GP (smectite) | | 9.8 |
| Ditallow dimethyl ammonium chloride | | 2.0 |
| Lauric acid | | 2.0 |
| Miscellaneous minors** | ca. | 3.5 |
| Moisture | | Balance |

*1.22:1 ratio of sodium tallow alkyl sulfate: sodium $C_{11.8}$ linear alkyl benzene sulfonate.

**Including brighteners, carboxymethylcellulose, coconut alcohol ethoxylate and perfume.

The composition of Example I, employed at a concentration of 0.12% by weight, provides simultaneous cleansing, softening and antistatic effects when employed in the washing cycle of a conventional home laundering process.

The anionic surfactant employed in Example I is replaced with each of the hereinbefore-specified anionic surfactants with similar results.

Substantially similar detergency, softening and antistatic benefits are obtained when the clay softening agent in Example I is replaced with an equivalent amount of volchonskoit, nontronite; nectorite; saucontie; and vermiculite, respectively, all such clays having an ion-exchange capacity of at least about 50 meq./100 g.

Substantially similar detergency, softening and antistatic benefits are obtained when the quaternary ammonium anti-static agent in Example I is replaced by ditallowdimethylammonium bromide; ditallowdiethylammonium chloride; dioctadecyldimethylammonium chloride; and ditallowdimethylammonium hydroxide, respectively.

EXAMPLE II

Through the wash-cycle fabric softener additive compositions having the following formulas are prepared:

| Components | Formula (In parts) | |
|---|---|---|
| Sodium bicarbonate | 7 | 13 |
| Ditallow dimethyl ammonium chloride | 8 | 4 |
| Lauric acid | 4 | 2 |
| Sodium montmorillonite | 21 | 21 |
| Extender granules* | 60 | 60 |

| | Parts |
|---|---|
| *Sodium linear dodecyl benzene sulfonate | 6 |
| Sodium silicate solids (ratio $SiO_2(Na_2O = 2.0)$ | 12 |
| Sodium carbonate | 12 |
| Sodium sulfate | 28 |
| Minors | 2 |

When employed in conjunction with a commercially available anionic-based built detergent composition in a conventional laundering process, the foregoing additive composition provides fabric softening and antistatic effect.

The extender granules employed in the composition of Example II are replaced with any inert or compatible filler materials such as sodium sulfate, starch, or the like with similar results:

What is claimed is:

1. A detergent-compatible granular fabric softening composition consisting essentially of:

a. from about 5 to about 90% by weight of a smectite clay having an ion-exchange capacity of at least 50 meq/100 grams;

b. from about 1 to about 40% by weight of a substantially water-insoluble quaternary ammonium antistatic agent of the formula:

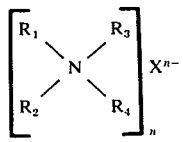

wherein $R_1$ and $R_2$ represent hydrocarbyl groups containing from about 10 to about 22 carbon atoms, $R_3$ and $R_4$ represent hydrocarbyl groups containing from 1 to about 4 carbon atoms, X is an anion and *n* is an integer from 1 to 3; and c. from about 1% to about 40% by weight of an acid compatibilizing agent to avoid affixing the quaternary compound to the surface of the clay said agent being selected from the group consisting of:

i. fatty acids having from about 8 to about 30 carbon atoms in the alkyl chain;

ii. compounds selected from the group consisting of benzene mono-, di- and tricarboxylic acid containing from 0 to 2 hydroxyl functions; and iii. mixtures of the above-described compounds.

2. A composition in accordance with claim 1 wherein the component (a) smectite clay is used to the extent from about 8 to about 75% by weight.

3. A fabric softening composition in accordance with claim 2 wherein the quaternary ammonium component is present to the extent of from about 2 to about 25% by weight.

* * * * *